US006092471A

United States Patent [19]

Early

[11] Patent Number: 6,092,471

[45] Date of Patent: Jul. 25, 2000

[54] CURVED RAIL COVER ACTUATOR

[75] Inventor: Stephen R. Early, Olathe, Kans.

[73] Assignee: Aero Transportation Products, Inc., Independence, Mo.

[21] Appl. No.: 09/207,941

[22] Filed: Dec. 9, 1998

[51] Int. Cl.[7] ..... B61D 39/00

[52] U.S. Cl. ..... 105/377.07; 105/241.2; 105/377.01; 105/377.05; 105/377.06; 414/329

[58] Field of Search ..... 105/377.01, 377.05, 105/377.06, 377.07, 241.2; 414/373, 329, 387, 389

[56] References Cited

U.S. PATENT DOCUMENTS

| | | | |
|---|---|---|---|
| 2,686,605 | 8/1954 | Kepner . | |
| 3,194,183 | 7/1965 | Schwartz, Jr. et al. . | |
| 3,251,487 | 5/1966 | Giesking . | |
| 3,316,858 | 5/1967 | Fritz . | |
| 3,384,031 | 5/1968 | Dashew et al. . | |
| 3,831,792 | 8/1974 | Waterman et al. | 105/377 |
| 4,417,840 | 11/1983 | Johnson | 414/329 |
| 5,355,808 | 10/1994 | Early . | |
| 5,517,925 | 5/1996 | Early . | |
| 5,697,121 | 12/1997 | Early . | |

*Primary Examiner*—S. Joseph Morano
*Assistant Examiner*—Lars A. Olson
*Attorney, Agent, or Firm*—Chase & Yakimo, L.C.

[57] ABSTRACT

An actuator automatically opens and closes the covers of a railroad hopper car as the car enters a loading/unloading station. The opening actuator includes a support frame disposed along a railroad track at the station that extends upwardly above the railroad car as it enters the station. An actuator bar is carried by the support frame and extends fore-and-aft of the railroad car adjacent the top thereof. The bar has an inclined unlatching segment for engagement by the latch arms of the covers to raise the arms and release the latches as the car passes thereunder, an intermediate substantially horizontally extending segment and a lifting segment for thereafter opening the covers as the car passes beneath the bar. The closing actuator includes a second support frame disposed along the track that extends upwardly above the car once unloaded. A closing bar is carried by the second frame and extends fore-and-aft of the empty car adjacent the top thereof. The closing bar has a closing segment aligned with the latch arms of the open covers of the car for engaging the arms and closing the covers. A hold-back bar is also carried by the second frame and is spaced apart from and generally level with the closing bar, to maintain the proper overlapping/underlapping relationship of the covers.

12 Claims, 8 Drawing Sheets

CURVED RAIL COVER ACTUATOR

FIELD OF THE INVENTION

This invention relates to an actuator for automatically opening and closing the hatch covers of a railroad car as the car enters and departs a loading/unloading station.

BACKGROUND OF THE INVENTION

Railroad hopper cars have been employed for years to transport particulate and granular materials, such as grain. Typically, a car is loaded through the use of overhead chutes that extend through one or more hatches or troughs formed in the top of the car.

One type of common hopper car presents a continuous trough extending substantially the length of the car which communicates with the top of the car and is closed during transport by a series of longitudinally extending end-to-end hatch covers. Each cover may be of from eight to thirteen feet in length and weigh on the order of 100 pounds. Some hopper cars include smaller port covers in addition to the main hatch covers, the port covers overlapping the adjacent main hatch covers as shown and described in U.S. Pat. No. 5,517,925 and incorporated herein by reference.

The hatch arrangements described above do not provide a means to gain access to the trough without manually raising the large, heavy hatch covers. Furthermore, this process can be very dangerous and requires the use of running boards installed along the sides of the cars at a height to provide access to the covers.

SUMMARY OF THE INVENTION

It is, therefore, a primary object of the subject invention to provide an actuator for automatically opening and closing the hatch covers of a railroad car as it enters and departs a loading/unloading station.

Another important object of the subject invention is to provide an actuator as aforesaid that has an elongated actuator bar carried by a support frame and extending generally fore-and-aft of the entering railroad car, that engages the hatch cover latches to open the hatches.

It is another important object of the subject invention to provide an actuator as aforesaid carried by a support frame that also extends generally fore-and-aft of the railroad car, that engages the hatch cover latches to close the latches.

Still another object of the subject invention is to provide an actuator for opening and closing the hatch covers of a railroad car that eliminates the need for manual opening and closing of the hatch covers and thereby decreases the risk of injury to railroad workers.

Still another object of the subject invention is to provide an actuator for opening and closing the hatch covers of a railroad car that facilitates the opening of the hatch covers.

Yet another object of the subject invention is to provide an actuator for opening and closing the hatch covers of a railroad car arranged in an overlapping/underlapping relationship.

Yet another object of the subject invention is to provide an actuator for opening and closing the hatch covers of every railroad hopper car of a train, including the hopper car hitched to a locomotive.

Yet a further object of the subject invention is to provide a railroad car hatch cover actuator that is cost effective and eliminates the expense and danger of running boards used by workers to access the hatch covers.

Other objects will become apparent as the detailed description proceeds.

These objects are attained by providing an opening actuator that includes a support frame adapted for disposition along a railroad track at a loading/unloading station and to extend upwardly above the railroad car as it enters the station. An elongated actuator bar is carried by the support frame and extends generally fore-and-aft of the entering railroad car adjacent the top thereof. The bar has an inclined unlatching segment for engagement by the latch arms of the cover to raise the arms and release the latches as the car passes thereunder. The bar also has a lifting segment for thereafter raising the covers to open positions as the car passes beneath the bar, whereby to automatically open the covers as the car enters the station.

A closing actuator includes a second support frame adapted for disposition along the track at the station that also extends upwardly above the car. An elongated closing bar is carried by the second frame and extends generally fore-and-aft of the car adjacent the top thereof. The closing bar has a closing segment aligned with the latch arms of the open covers of the car for engaging the arms and causing return movement of the covers to their closed positions. A hold-back bar may also be carried by the second frame and is spaced apart from and generally level with the closing bar, to maintain the overlapping/underlapping relationship of the covers.

DETAILED DESCRIPTION

Figure 1:
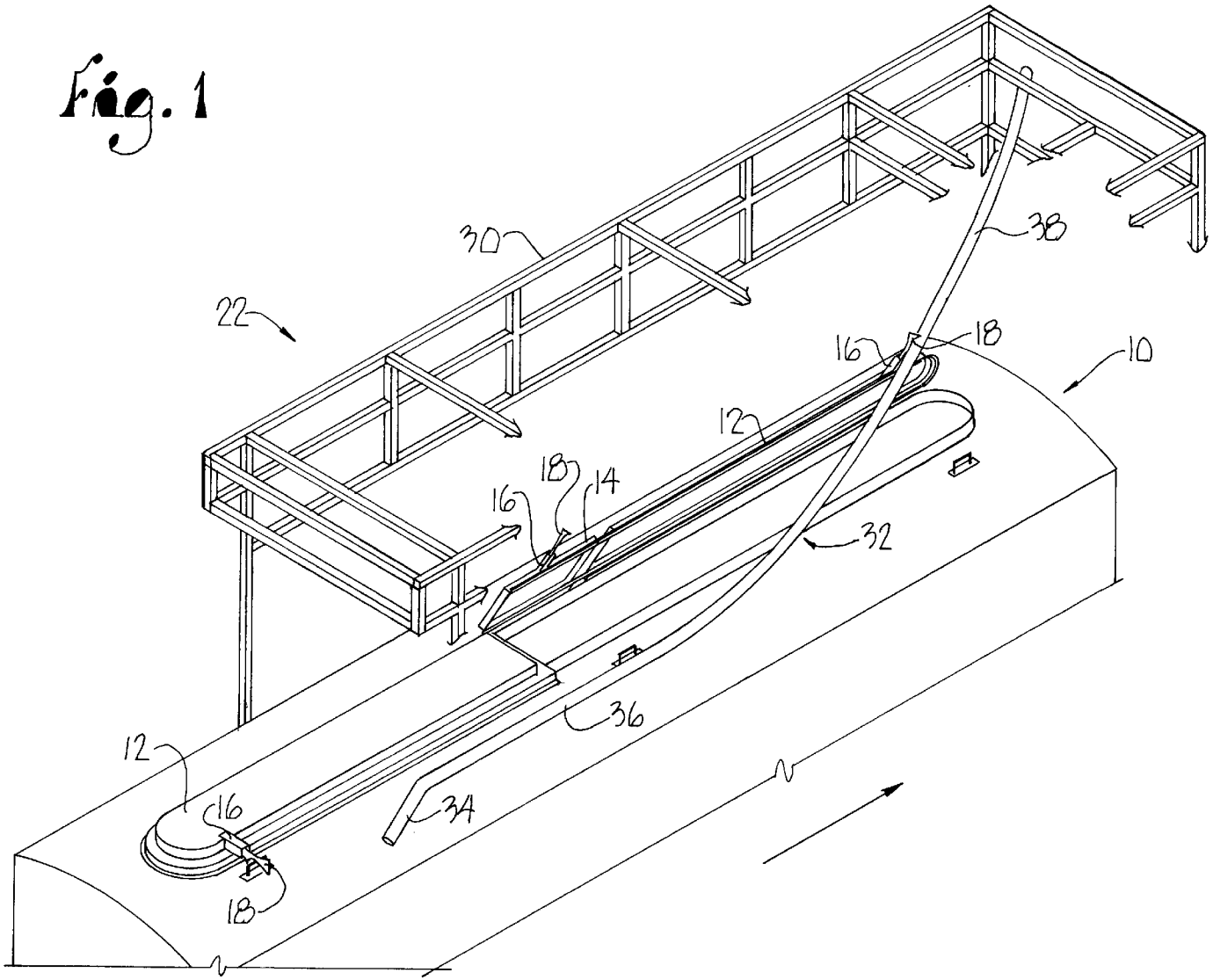
FIG. 1 is a perspective view of the opening actuator of the railroad car cover actuator in accordance with the present invention but with the support broken away for clarity, and shows a main hatch cover and an adjacent port cover of a railroad car after having been opened by the guide bar.

Referring initially to FIG. 1, railroad car 10 is a conventional hopper car having front and rear primary. covers 12 and an access port cover 14 arranged and constructed substantially in accordance with U.S. Pat. No. 5,517,925 (the '925 patent), but with the port cover 14 shown herein as being rectangular. Also, for ease of illustration, a three cover arrangement is shown herein as opposed to the more common five cover arrangement shown in the '925 patent. Similar to the five cover arrangement of the '925 patent, the primary covers 12 underlap the overlapping port cover 14. Covers 12 and 14 are secured by latches 16 without the need for battens in accordance with U.S. Pat. No. 5,355,808 also incorporated herein by reference. Latches 16 include arms 18 extending outwardly therefrom, spaced above the top surface of the railroad car 10.

Figure 11:
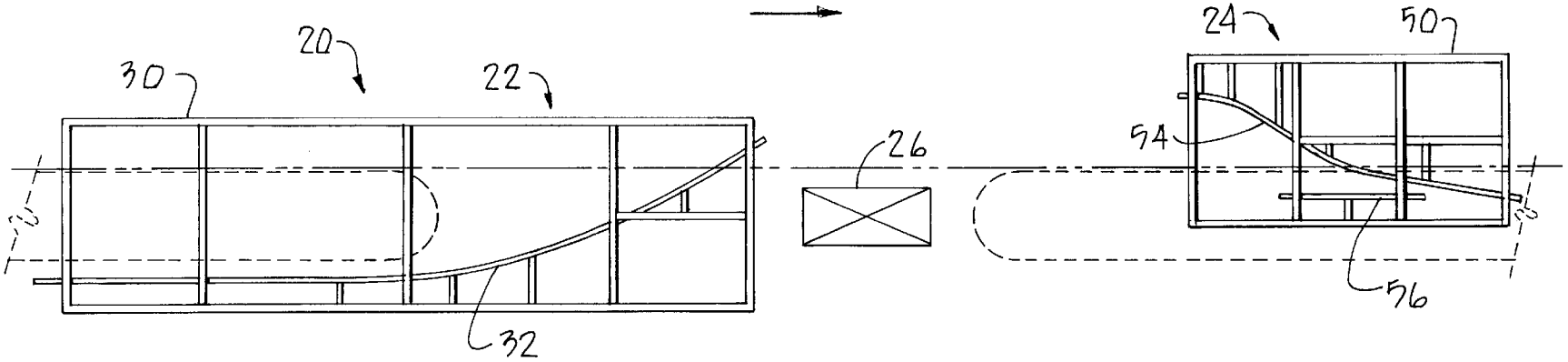
FIG. 11 is a top plan view illustrating the relationship between opening and closing actuators of the loading/unloading station, with the railroad car hatches shown in phantom.

Actuator 20 of the present invention automatically unlatches the covers 12 and 14 and opens and closes the hopper car's ports 12 and 14 during loading and unloading. Actuator 20 includes an opening portion 22, as seen in FIGS. 1–5, and a closing portion 24, as seen in FIGS. 6–10, which are disposed along a railroad track at a loading/unloading station, as seen in FIG. 11. For purposes of discussion herein, the"station" includes that area along a railroad track that immediately precedes and follows a loading chute 26. Opening actuator 22 includes support frame 30 and an elongated opening actuator guide bar or rail 32. Support frame 30 is disposed along a railroad track preceding the loading chute 26 at the station and extends upwardly above the railroad car 10 as it enters the station. The support frame 30 carries the guide bar 32 thereon.

Guide bar 32 is securely and fixedly mounted to the frame 30 and extends generally fore-and-aft of the entering railroad car 10 adjacent the top thereof. Guide bar 32 includes an upwardly inclined or angled unlatching segment 34, a substantially horizontally extending intermediate section 36 and a final curved, lifting segment 38.

Figure 2:
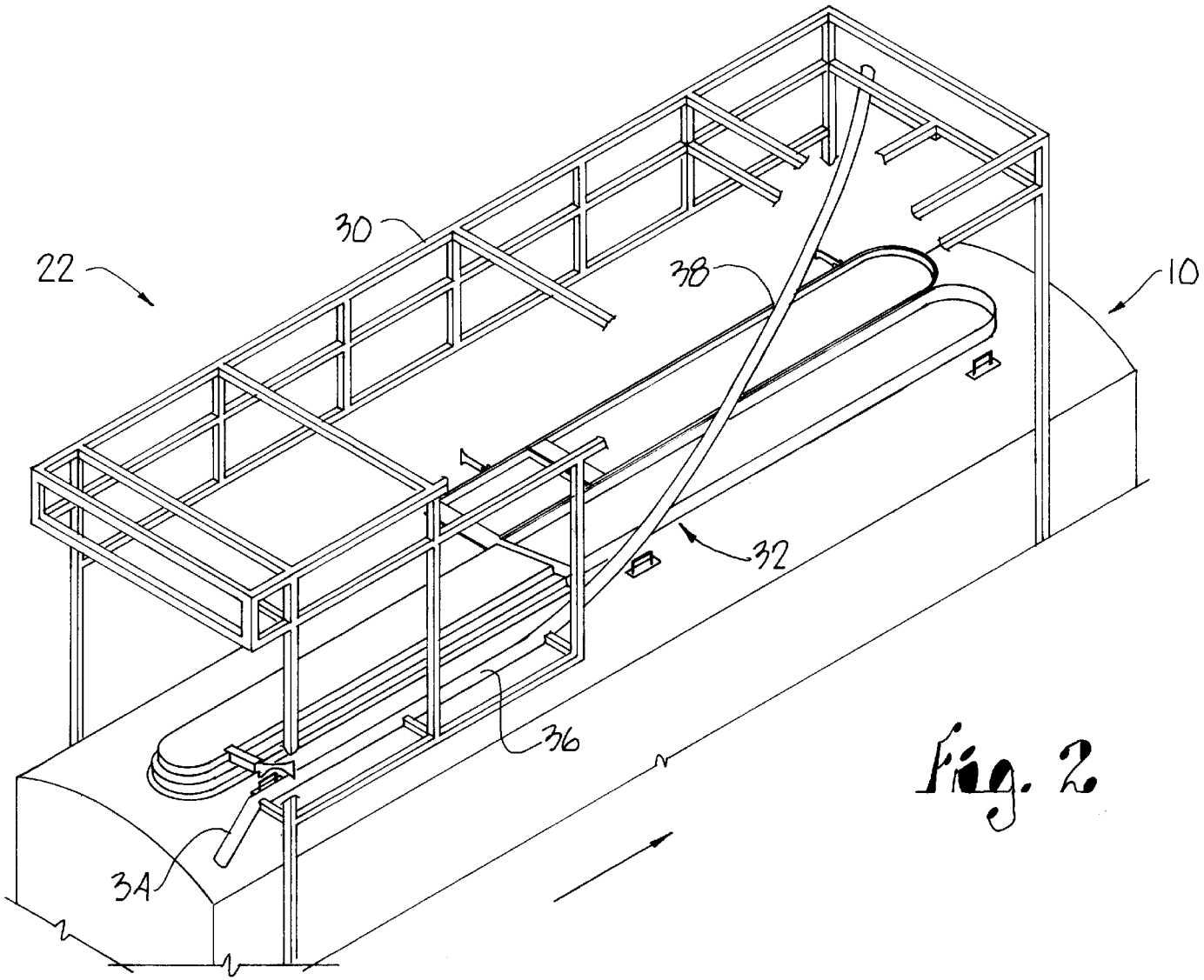
FIG. 2 is a perspective view of the opening actuator as in FIG. 1,.showing the railroad car's second main hatch cover being opened thereby.
Figure 5:
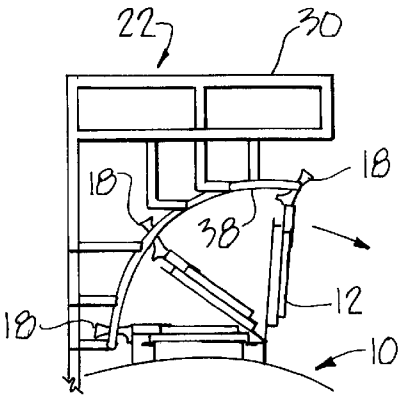
FIG. 5 is a right end view of the opening actuator of FIG. 1 showing a railroad car cover being opened thereby.
Figure 3:
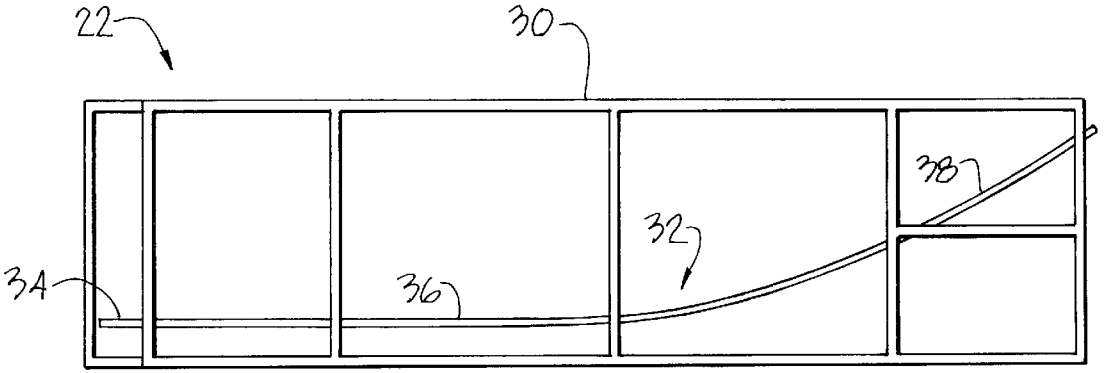
FIG. 3 is a top plan view of the opening actuator of FIG. 1.
Figure 4:
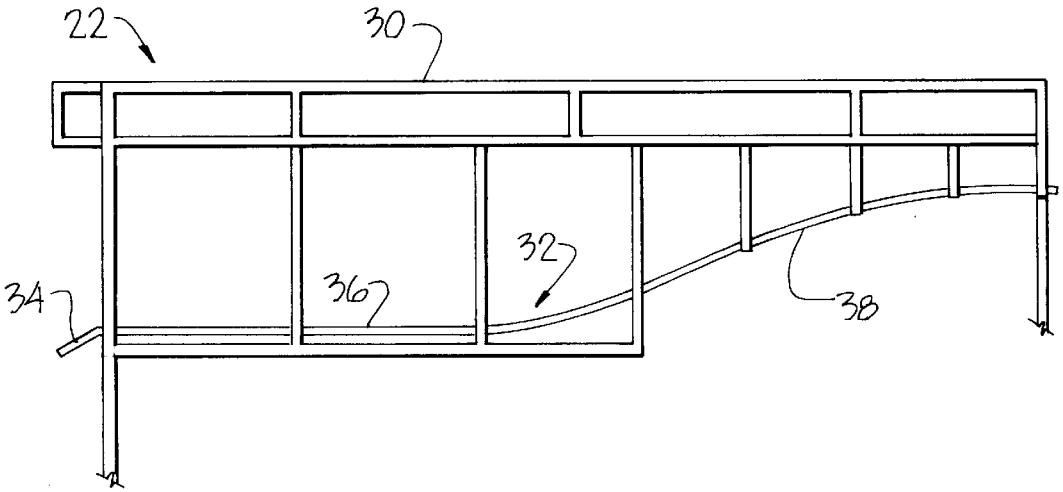
FIG. 4 is a side elevation view of the opening actuator of FIG. 1.

As seen in FIGS. 1 and 2, guide bar 32 engages the latch arms 18 to automatically open the covers 12 and 14 as the railroad car 10 enters the station. More specifically, with the railroad car 10 moving in reverse (i.e., being backed in by a locomotive) in the direction of the arrows, unlatching segment 34 engages the latch arms 18 of the railroad car 10 to raise the arms 18 and release the latches 16 as the car 10 passes thereunder. The horizontally extending intermediate segment 36 is of sufficient length to allow the overlapping port cover 14 that immediately follows the adjacent preceding unlatched underlapping primary cover 12 to be unlatched before the preceding primary cover 12 is opened by the final lifting segment 38. This segment 38 then raises and swings both the covers 12 and 14 open simultaneously as in FIG. 1. Thereafter, the following or subsequent primary cover 12 is unlatched, as in FIG. 2, and then opened.

Figure 6:
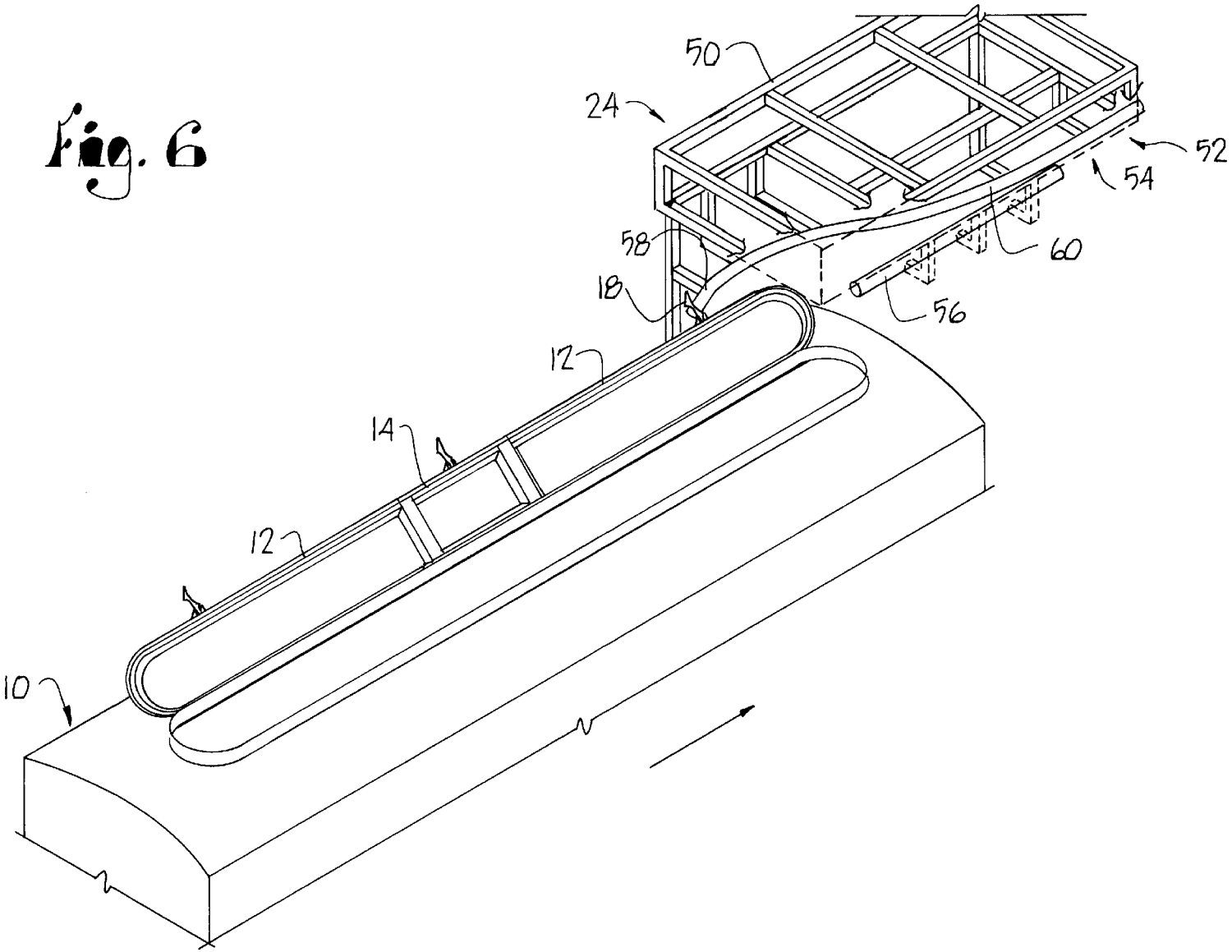
FIG. 6 is a perspective view of the closing actuator of the railroad car cover actuator in accordance with the present invention showing the railroad car's first hatch being engaged thereby.
Figure 7:
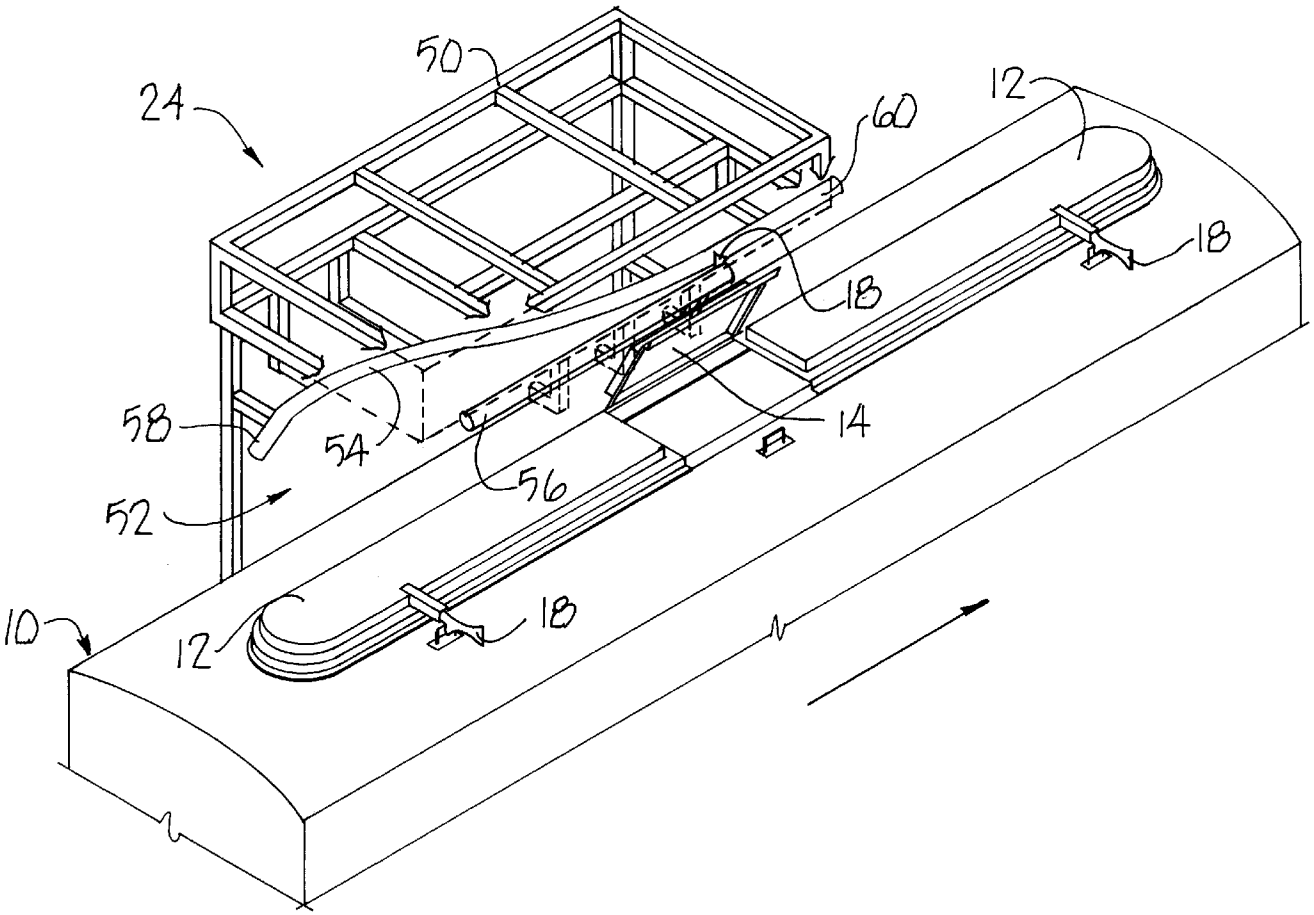
FIG. 7 is a perspective view of the closing actuator of FIG. 6 showing the car's main hatch covers closed and the actuator's hold-back bar preventing premature closure of the port cover to maintain the proper overlapping/underlapping relationship of the covers.
Figure 10:
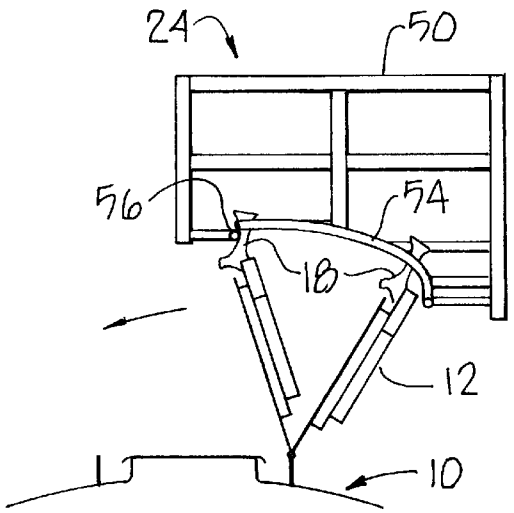
FIG. 10 is a right end view of the closing actuator of FIG. 6, showing a railroad car cover being closed thereby.
Figure 8:
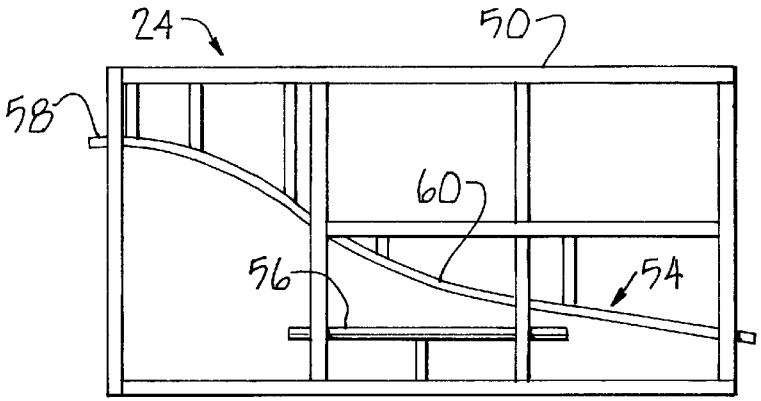
FIG. 8 is a top plan view of the closing actuator of FIG. 6.
Figure 9:
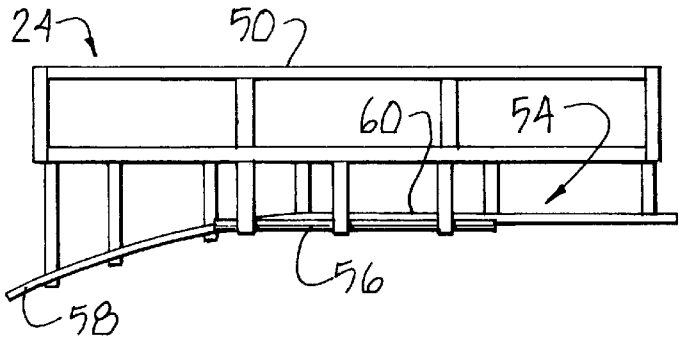
FIG. 9 is a side elevation view of the closing actuator of FIG. 6.

Once unloaded and/or loaded by the chute 26, the car 10 continues in reverse in the direction shown in FIGS. 6–7 until it reaches the closing actuator 24. The closing actuator 24 includes a support frame 50, elongated closing guide bar 52 and hold-back bar 56.

The support frame 50 is similar to the support frame 30 of the opening actuator 22. The support frame 50 is disposed along the railroad track at the station following the loading chute 26 and extends upwardly above the railroad car as it enters the closing actuator 24 with the support frame 50 being preferably located on the opposite side of the railroad track from the support frame 30 of the opening actuator 22. The support frame 50 carries the closing guide bar 52 and hold-back bar 56 thereon.

The closing bar or rail 52 is securely and fixedly mounted to the support frame 50 and extends fore-and-aft of the entering railroad car 10 adjacent the top thereof. The closing bar 52 includes an initial inclined or angled engaging segment 58 and a closing segment 60.

The engagement segment 58 is aligned with the latch arms 18 of the open covers 12 and 14 of the railroad car 10 for initially engaging the arms 18 during the closing process, as seen in FIG. 6. Closing segment 60 is curved and inwardly sweeping to cause return movement of the covers 12 and 14 to their closed positions.

The hold-back bar 56 is substantially level with the closing segment 60 of the closing bar 52 but is spaced apart therefrom. The hold-back bar 56 allows the primary covers 12 to close before any adjacent overlapping port cover 14, to maintain the necessary overlapping/underlapping relationship between the covers 12 and 14. In particular, as seen in FIG. 7, the port cover 14 is held back from closing while the adjacent primary covers 12 are allowed to close. Once all of the covers 12 and 14 are closed, the train can be pulled forward out of the station.

Figure 12:
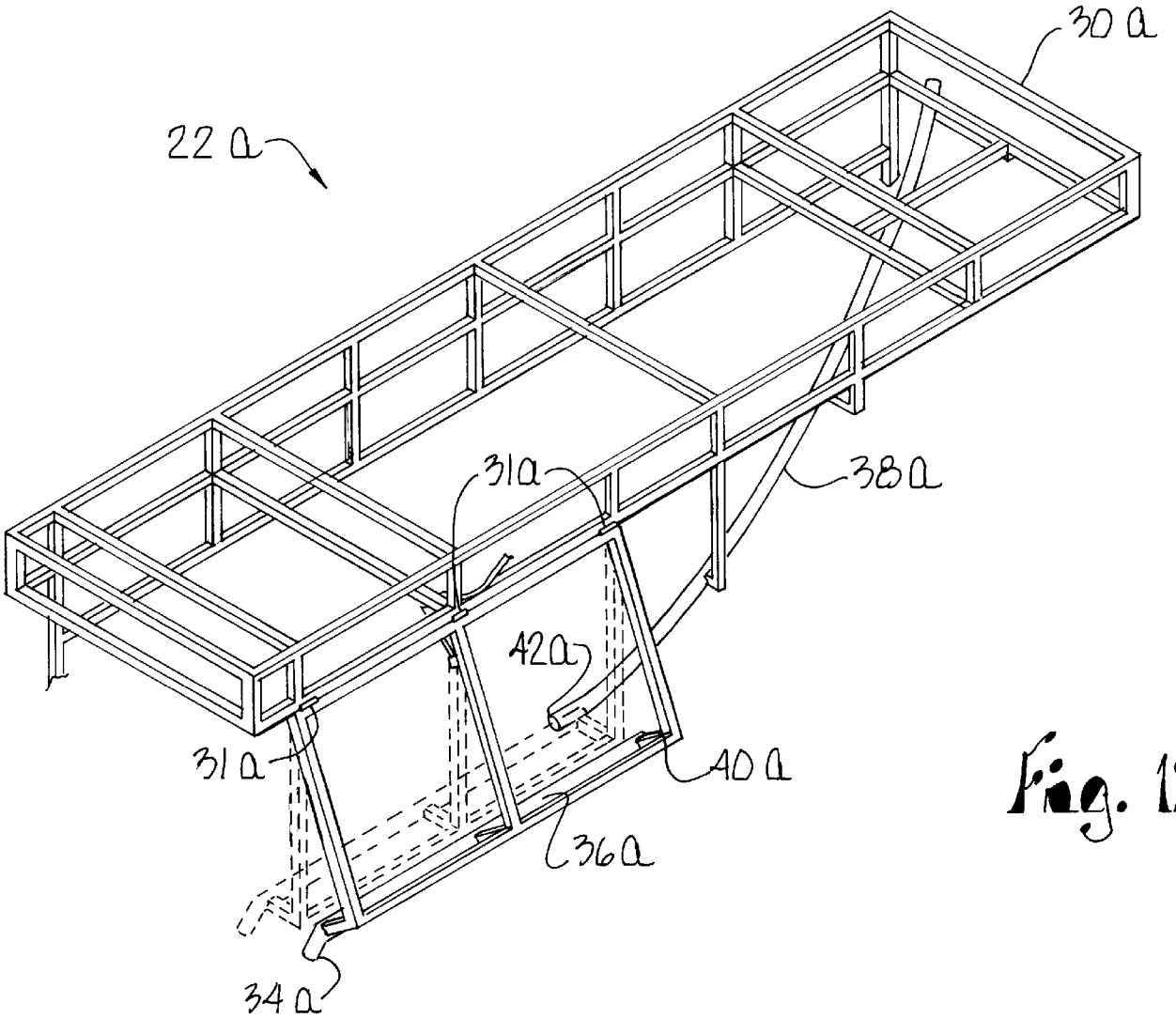
FIG. 12 is an alternate embodiment of the actuator in accordance with the present invention illustrating its pivotable opening guide bar.

An alternative embodiment of the opening portion 22*a* is shown in FIG. 12. As is commonly understood, in connecting railroad cars together to form a train, one car must be connected to a locomotive. Locomotives are generally wider and/or taller than hopper cars. This alternative embodiment allows the covers of a railroad hopper car that is hitched or connected to a locomotive (or any other type of car having larger dimensions) to be loaded and/or unloaded using the actuator.

In this embodiment, the unlatching segment 34*a* and the horizontal segment 36*a* present a first guide bar and are pivotably mounted to the support frame 30*a* at hinges 31*a* to allow a locomotive to move through the opening portion 22*a* of the actuator. The segments 34*a* and 36*a* pivot outwardly and upwardly, as illustrated in FIG. 12, away from any car passing through the opening portion 22*a* once each cover is unlatched, to allow a leading locomotive to pass into the opening portion 22*a* of the actuator. The segments 34*a* and 36*a* are preferably pivoted automatically using conventional technology, such as an infrared controller. The lifting segment 38*a* presents a second guide bar and is fixedly mounted to the support 30*a*. Segments 36*a* and 38*a* have juxtaposed ends 40*a* and 42*a* which prevent the latch arms of any cover from becoming disengaged therefrom.

Thus, the actuator 20 eliminates the need for manual opening and closing of railroad car hatch covers, which is difficult and dangerous due to their weight and location. Furthermore, the actuator 20 is cost effective since it eliminates the need for expensive running boards which have been necessary for providing access to the hatch covers.

Having thus described the invention, what is claimed as new and desired to be secured by Letters Patent is as follows:

1. A railroad car cover actuator, comprising:

a support frame;

first means, mounted to said support frame, for engaging a railroad car cover latch to open the cover as the car enters a loading station;

second means, mounted to said support frame, for engaging a railroad car cover latch to close the cover as the car leaves the loading station;

said first means including an unlatching segment and an opening segment;

said second means including a closing segment and a holdback segment.

2. A railroad car cover actuator as claimed in claim 1 wherein said unlatching segment presents a guide bar pivotably mounted to said support frame to allow railroad cars to pass through said actuator.

3. A railroad car cover actuator as claimed in claim 1 wherein said hold-back segment is spaced apart from and substantially level with said closing segment, to prevent a cover from closing prematurely.

4. A railroad car cover actuator as claimed in claim 1 wherein said unlatching segment includes an initial inclined portion and an intermediate substantially horizontally extending portion.

5. A railroad car cover actuator as claimed in claim 1 wherein said first means is a single guide bar.

6. A railroad car cover actuator as claimed in claim 2 wherein said opening segment presents a second guide bar.

7. In combination with a railroad car having a plurality of end-to-end covers, each of which is swingable about a fore-and-aft axis of the railroad car between a closed and an open position and which is normally secured in the closed position by a latch having an outwardly projecting arm for securing and releasing the latch, an actuator for opening the covers as the car enters a loading/unloading station, comprising:

a support frame adapted for disposition along a railroad track at the station and extending upwardly above the railroad car as it enters the station, means for actuating carried by said support frame and extending generally fore-and-aft of the entering railroad car adjacent the top thereof, and said means for actuating having an inclined unlatching segment for engagement by the latch arms of the car to raise the arms and release the latches as the car passes thereunder, and a lifting segment for thereafter raising the covers to open positions as the car passes beneath the bar, whereby to automatically open the covers as the car enters the station.

8. The combination as claimed in claim 7, further comprising:

a second support frame adapted for disposition along the track and extending upwardly above the car at the station, an elongated closing bar carried by said second frame and extending generally fore-and-aft of the car adjacent the top thereof, and said closing bar having a closing segment aligned with the latch arms of the open covers of the car for engaging the arms and causing return movement of the covers to their closed positions.

9. The combination as claimed in claim 7 wherein said unlatching segment presents a guide bar pivotably mounted to said support.

10. The combination as claimed in claim 9 wherein said lifting segment presents a second guide bar.

11. The combination as claimed in claim 7 wherein said means for actuating presents an elongated guide bar.

12. The combination as claimed in claim 8 further comprising a hold-back bar carried by said second frame and being spaced apart from and generally level with said closing bar, to maintain a overlapping/underlapping relationship of the covers.

* * * * *